US005184678A

United States Patent [19]

Pechkov et al.

[11] Patent Number: 5,184,678

[45] Date of Patent: Feb. 9, 1993

[54] ACOUSTIC FLOW STIMULATION METHOD AND APPARATUS

[75] Inventors: Andrey A. Pechkov; Oleg L. Kouznetsov; Veniamin V. Drjaguin, all of Moscow, U.S.S.R.

[73] Assignee: Halliburton Logging Services, Inc., Houston, Tex.

[21] Appl. No.: 648,062

[22] Filed: Jan. 31, 1991

[30] Foreign Application Priority Data

| | | | |
|---|---|---|---|
| Feb. 14, 1990 | [SU] | U.S.S.R. | 4788664 |
| Jun. 5, 1990 | [SU] | U.S.S.R. | 4826680 |
| Jun. 5, 1990 | [SU] | U.S.S.R. | 4826681 |

[51] Int. Cl.[5] ..... E21B 43/24; E21B 43/25

[52] U.S. Cl. ..... 166/249; 166/177

[58] Field of Search ..... 166/249, 177

[56] References Cited

U.S. PATENT DOCUMENTS

| | | | |
|---|---|---|---|
| Re. 23,381 | 6/1951 | Bodine, Jr. | 166/249 |
| 2,670,801 | 3/1954 | Sherborne | 166/249 |
| 2,700,422 | 1/1955 | Bodine, Jr. | 166/249 |
| 3,322,196 | 5/1967 | Bodine, Jr. | 166/249 |
| 3,497,005 | 2/1970 | Pelopsky et al. | 166/249 X |
| 3,754,598 | 8/1973 | Holloway, Jr. | 166/249 |
| 4,512,402 | 4/1985 | Kompanek et al. | 166/249 |

*Primary Examiner*—Stephen J. Novosad
*Attorney, Agent, or Firm*—William J. Beard

[57] ABSTRACT

A method and apparatus for stimulating fluid production in a producing well wherein a well stimulating tool comprising a sealed tool housing with an acoustic transducer in the housing. The tool is run into a producing well on an electric wireline and placed at a depth opposite perforations in a producing zone. The sealed housing of the tool contains a liquid to couple and enable pulses of acoustic energy from the acoustic transducer to be transmitted through the housing into well formation fluids surrounding the housing to reduce the viscosity of the formation fluids by agitation and thereby enhance fluid flow from the formation into the producing well.

14 Claims, 3 Drawing Sheets

ACOUSTIC FLOW STIMULATION METHOD AND APPARATUS

BACKGROUND OF THE DISCLOSURE

The present disclosure is directed to a process for treating a producing well and particularly one for treating a well where production has fallen over a period of time. The normal completion process involved in producing a well after drilling includes cementing casing in the well and then making perforations by means of shaped charges which perforate through the casing and any surrounding cement which holds the casing in place. The perforations penetrate into producing formations. Assuming that fluid production is obtained, the production fluids flow from the formation into the cased well. The production fluids are removed to the surface normally by installing a production tubing string in the cased well. For instance, the production tubing string typically measures 2⅜ inches, or perhaps 2⅞ inches. This defines an annular spaced around the production tubing string within the cased well borehole. The zone of fluid production is normally isolated with packers or plugs. A plug is normally placed in the casing just below the perforations. This enables a column of production fluid to accumulate above the plug. For production, there is also a plug or packer positioned above the perforations, and the production tubing string extends through this packer. Thus, the produced fluids from the formations are removed upwardly through the production tubing string usually by pumping or by gas lift apparatus.

Normally, after the passage of time, there is some loss of formation pressure in the localized formation region immediately adjacent to the well borehole near the perforations into the formation. This loss of production is occasioned also by a loss of fluid flow velocity. As the velocity decreases, the small cracks and fissures in the vicinity of the perforations may become clogged or plugged with silt, clay or other formation debris which is generally referred to as "fines". As well be understood, a higher pressure drive will tend to move the production fluids more rapidly through the perforations and into the cased well borehole. That however declines as sediment or fines in the produced fluid collects in the cracks and fissures connecting with the perforations. In other words, as the pressure drive decreases, it is decreased even further by sediment or fines in the flowing production fluids which falls out in the immediate region of the perforations. While this is a localized effect, it is nevertheless detrimental to production of fluids even where the formation or reservoir has ample fluids for production. The decline in production requires remedial treatment. There are multiple ways to treat such a well including further stimulation of the well by means of high pressure fracture, an injection of acid, etc. The present disclosure is directed to a particular well stimulation process which can materially ehance the production. Thus, it is a wireline conveyed tool which can be lowered on a wireline through the production tubing. It can be lowered to a location adjacent to the perforations without shutting in the well. Acoustic or sonic energy is generated by the tool and the acoustic vibrations are coupled from the tool through the incompressible liquids which make up the formation fluids to impinge on the formation to change the nature of the formation and to interact on both the formation materials including any fines or sediments which may settle in the perforations, in addition, the acoustic energy interacts with the formation fluids. This interaction serves to reduce formation fluid viscosity thereby enhancing volume fluid flow at a given pressure.

The materials which are found immediately outside the perforations are often multi-phase materials involving some, perhaps much water, and different weights of petroleum fluids, some of which might be natural gas and some which might be so heavy as to be tar like in nature. All of this material can be found in a producing sand formation which may be described generally as a supportive matrix with some given range of permeability to permit fluid flow from the formation into the well. The intersticial spaces in the formation normally provide sufficient connected pore space to enable fluid flow. The well fluid can carry fines which are sufficiently small that they can lodge or settle in the interstices of the formation and thereby tend to clog or plug the small connected pores of the formation. While there is no simple model to describe this, it is sufficient to note that there is a relatively complex interplay between the various solid, liquid and gas phase components as described above which can plug or impede flow in this region.

The present procedure contemplates the irradiation of the formation with acoustic energy at a selected power distribution and frequency. This irradiation agitates the fines so that they go back into fluidic suspension and can be removed with formation fluid flow. In addition, the irradiation appears to reduce the viscosity of the well fluids, thereby enabling enhanced fluid flow. Repetitive irradiation appears to clear or clean the pores or passage ways at and surrounding the perforations into the formations, thereby enhancing well fluid production.

The present apparatus is described very generally as a sonde which is adapted to be lowered in a well borehole on a wireline which supports the device at specified depths for remedial treatment of perforations and the immediate regions just beyond the perforations. The sonde houses one or more acoustic transducers which are operated at selected frequencies. Frequencies up to perhaps 20 or 30 kilohertz are generated to provide the appropriate irradiation. Acoustic power of a few hundred to a few thousand watts is delivered to the formation. The power density ranges anywhere from about 1 watt/cm$^2$ to values less than this. This power level is sufficient to break free coagulated fines, and to also reduce the viscosity of the well fluid so that the fluid may flow more readily. In summary, well stimulation can be accomplished by selectively and repetitively irradiating the region of the perforations to obtain this improved production flow rate.

BRIEF DESCRIPTION OF THE DRAWINGS

So that the manner in which the above recited features, advantages and objects of the present invention are attained and can be understood in detail, more particular description of the invention, briefly summarized above, may be had by reference to the embodiments thereof which are illustrated in the appended drawings.

It is to be noted, however, that the appended drawings illustrate only typical embodiments of this invention and are therefore not to be considered limiting of its scope, for the invention may admit to other equally effective embodiments.

DESCRIPTION OF THE PREFERRED EMBODIMENTS

Figure 1:
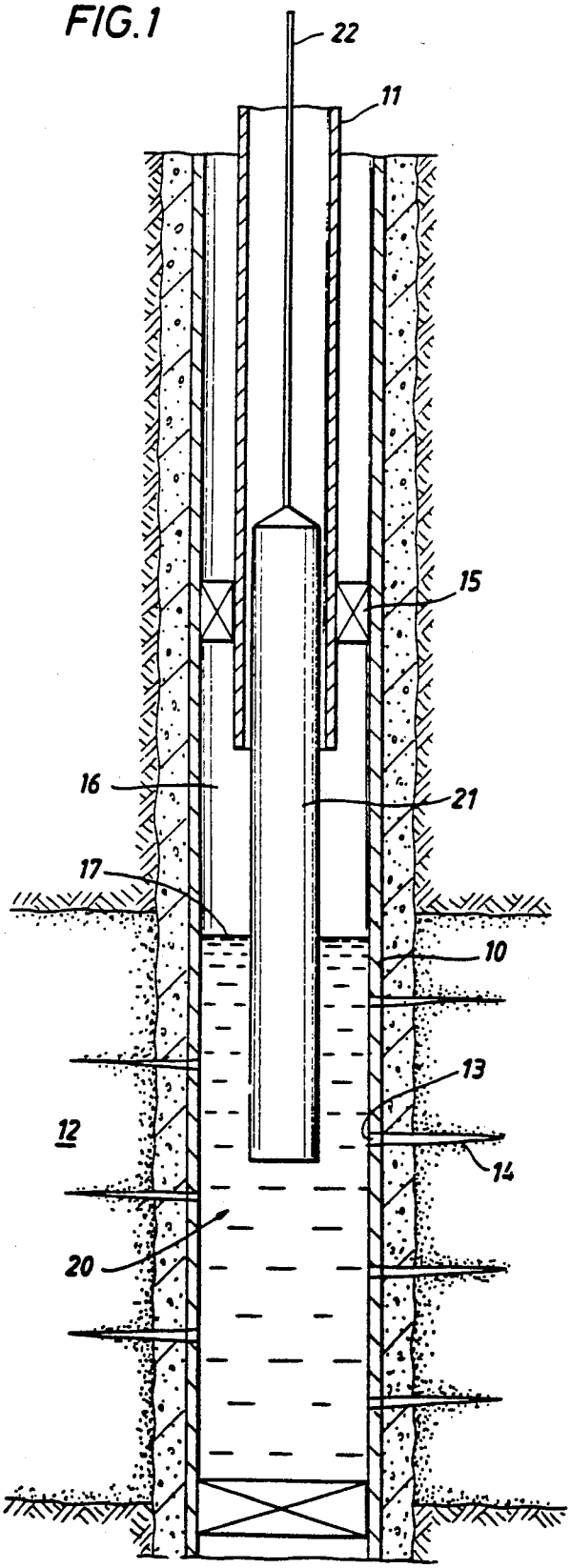
FIG. 1 shows an irradiation tool in accordance with the present invention lowered on a wireline in a production casing string and positioned opposite perforations through the cased well into the adjacent producing formations.

Attention is now directed of FIG. 1 of the drawings which schematically shows a cased well having perforations 14 extending into a producing formation 12. In FIG. 1, the casing is identified by the numeral 10, and is normally cemented to the formations which are penetrated by the well borehole. The cement layer has been omitted for sake of clarity. The cased well supports a string of production tubing 11 which is coaxially positioned within te cased well. The production tubing string provides a flow path for the production fluid from the formation 12. The formation 12 is a producing formation having appropriate permeability so that production fluids from the formation flow through perforations 14 into the cased well. The production is accomplished through a set of perforations at 14. The perforations form aproximately circular holes 13 in the casing and form a puncture pathway 14 into the formation 12. Typically, there are several perforations and they extend radially outwardly from the cased well. They are spaced at even locations along the length of the casing where it passes through the formation 12. Ideally, the perforations are located only in the producing formation 12, and hence the number of formation perforations varies dependent on the thickness of the formation 12. It is not uncommon to have as many as 9 to 12 perforations per meter of formation thickness. Moreover, perforations extend in all longitudinal directions, thus, there are perforations which might extend radially at 0° azimuth, and additional perforations arranged every 90° to thereby define four sets of perforations around the azimuth.

Formation fluid flows through the perforations 14 to enter the cased well. Preferably, the well is plugged with some type of plugging mechanism such as a packer or bridge plug below the perforations. In addition to that, a packer 15 is positioned above the formation 12. The packer 15 connects with the production tubing 11 to define a chamber 16 where production fluid flows from the formation 12 into the chamber and tends to fill the chamber. The chamber can have a height which is determined by the spacing between the plug below and the packer 15 above the formation 12. The fluid capacity of the chambers varies depending upon the height of the chamber. The production fluid flows out of the formation and into the chamber 16 and accumulates in the chamber to some height, perhaps even filling the chamber. Production fluid is shown accumulated to the fluid level 17 in the chamber 16. The accumulated fluid flow from the formation may also be accompanied by the production of variable quantities of natural gas. In summary, the casing chamber 16 will accumulate some water, perhaps oil, perhaps natural gas and also sand or solid debris. The sand will normally settle to the bottom of the chamber 16. The fluid produced from the formation may change phase in the event of pressure reduction from formation pressure which permits some of the lighter molecules to vaporize. On the other hand, the well may also produce very heavy tar molecules. This variety of fluid weights is readily accommodated by the apparatus of the present invention.

Over a period of time, the perforation pathways 14 extending into the formation 12 can clog with fines or debris. As will be understood, these pathways 14 are represented in the drawings as neatly defined conics but this is not always the case. In fact, passageways 14 are typically defined around the edges by numerous cracks, fissures, and surface irregularities which extend into the formation 12. This defines a fluid connected pore space within the formation to enable fluids to flow from the formation through cracks or fissures or connected pores and flowing through the interstical spaces into the chamber 16 for collection. During this flow, very small solid particles of the formation known as fines can flow, but they tend to settle. While the fines might be held in a dispersed state for a while, they may drop out and thereby plug or clog the pore spaces and reduce the fluid production flow rate. When this occurs, the well will slowly lose production. This may become a problem which feeds on itself, namely as the production flow rate drops, more and more fines can settle in the perforations and block these perforations, tending to prevent even a minimal rate of flow.

Apparatus according to concepts of the present invention is identified by the numeral 20 and comprises an elongate housing 21 known as a sonde which is lowered into the well on an armored cable or wireline 22. One or more electrical conductors are provided in the cable 22. These provide power and communications to the equipment as will be described in more detail.

Figure 2:
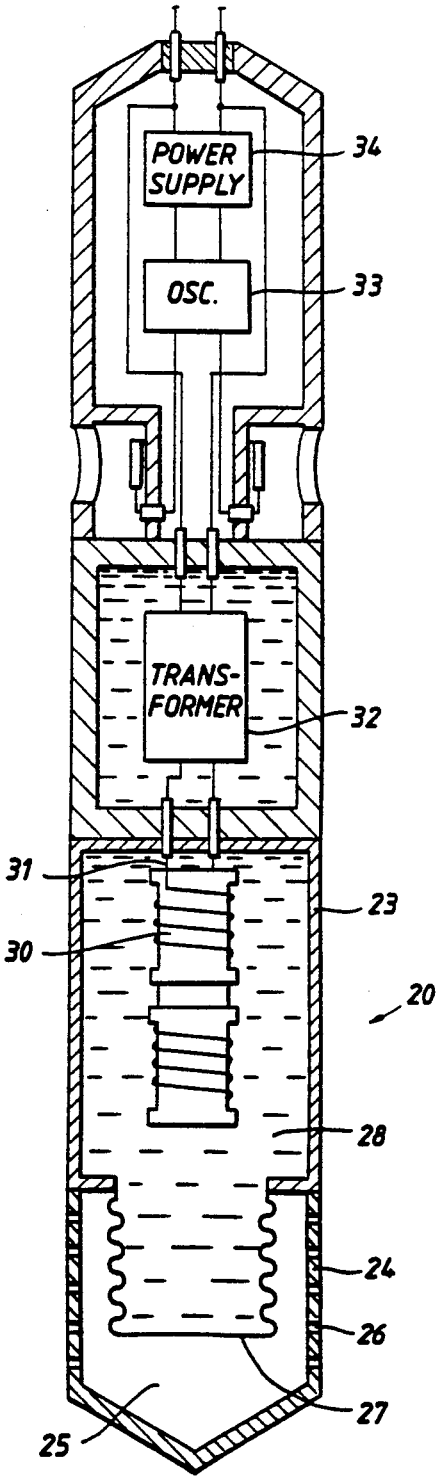
FIG. 2 is a sectional view through an acoustic pulse generating device.

Attention is now directed to FIG. 2 of the drawings where a downhole well tool according to the present invention is identified in greater detail. The tool 20 is shown in schematic sectional view through the apparatus. More specifically, it includes a closed cylindrical housing 23 which is formed of a material which will transmit acoustic vibrations. Moreover, it is connected to a cylindrical extension 24 of equal diameter having an internal cavity 25. The cavity 25 is connected with the exterior by means of small holes 26. Fluid may flow through the small holes 26 into the cavity 25. This delivers borehole fluid at ambient well bore pressure into the equipment. The fluid acts on an expandable set of bellows 27. The bellows 27 permit some expansion of the fluid in the housing 23. That housing is filled with a fluid 28 which completely fills the chamber 19. In the chamber, a magnetostrictive acoustic transducer 30 is centrally supported. It is wrapped with a coil of wire 31. The coil 31 connects with suitable electrical conductors extending to a transformer 32 in a separate chamber within the tool. The transformer 32 provides coupling between the magnetostrictive coil 31 and the driving source connected with the equipment. The transformer 32 provides an impedance match for operation. In turn, a pulsed oscillator 33 drives the transformer 32. That is provided with power for operation from a power supply 34 which is provided with power from the surface by conductors in the logging cable connected to the acoustic signal transducer equipment 20.

The power supply 34 is provided with power to form an output power pulse. The output power pulse is delivered to the oscillator 33. The oscillator is operated at a selected frequency. The oscillator's frequency output is a continuous wave (CW) output signal which is pulsed on and off. As an example, the operating frequency is typically in the area of about 20 kilohertz (khz), but operation in the range of about 2 to30 khz is permissible. The oscillator 33 is pulsed on and off at a rate where pulses are formed every few milliseconds, for instances with pulses formed every 10 to 100 milliseconds. The power output is transmitted in pulse form in an omnidirectional propagation mode. Ideally, 1000 to perhaps 2000 watts of power is delivered by the magnetostrictive transducers 30. The acoustic radiation is transmitted radially outwardly to pass through the wall of the housing 23. It is coupled through the liquid 28 in the chamber which is at borehole pressure, through the wall, through the well fluid that surrounds the tool and into the casing 10 and perforations 14 to impinge on the formation 12. The transmission of the acoustic pulses provides mechanical vibratory coupling into the formation 12. Assume for purposes of illustration that the transducer 30 has a height of 25 cm. At a radial distance of 25 cm, the acoustic energy transmitted into the formation impinges on an equivalent surface area of about 4000 $cm^2$ at a radial spacing of 25 cm from the axis of the equipment. If the equipment is operated with a power of about 2000 watts, this energy distribution on such a surface is approximately 0.5 watts per $cm^2$. This power level has been found to be sufficient to agitate sedimentary fines in the pore spaces of the formation 12. The device can be pulsed at a pulse repetition rate ranging from perhaps 10 pulses per second to about 1000 pulses per second. The duty cycle can range anywhere from 30% to 70%. When the transducers 30 are on, it generates this second CW acoustic pulse which impinges on the formation, routinely passing through the perforations 14 and into the formation at the interface beyond the perforations so that fluid flow is enhanced. The treatment of a particular set of perforations can be repeated in this manner for several hours. The sonde apparatus may be moved to different depth levesl in the borehole, and thus the treatment is applied to several locations or sets of perforations as desired. All of this, of course, may be done while the well is under production conditions.

It has been discovered that the present apparatus enhances production by changing the viscosity of the fluid. To be sure, fluid flow is also changed by altering the sedimentation rate of the small fines. That is, prior accumulations of sediment in the pores of the formation are broken up. When this occurs, there is a tendency to flush out the pores so that the sedimentary fines are carried by fluid flow away from that region. That enhances the production of the well. This particularly provides a long term effect in that the fine agitation which occurs during irradiation tends to clear the perforations and thereby remove the clogging sediment which otherwise impedes fluid production. As a consequence, production is improved long after the acoustic irradiation tool 20 has been removed.

A typical procedure is to provide acoustic irradiation to a specific depth region of the well for a selected interval such as 5 to 50 minutes. After irradiation, the tool is lowered or moved to another horizon in the well for irradiation at that level. The magnetostrictive transducer has a specified length along the well so that it can irradiate a specified length of the well such as 25 cm, or perhaps one meter in a longer embodiment. Each separate irradiation operation is achieved by raising or lowering the tool as needed to the necessary depth in the well whereby the entire formation 12 is successfully irradiated. As a generalization, it is desirable to irradiate the entire set of perforations in the formation 12, thereafter removing the tool 20, and returning several months later to repeat the process. When the sedimentary fines are dislodged and carried by fluid flow out of the perforations into the cased chamber within the well, they collect either at the bottom of the chamber 16 or they are produced by the upwardly production flow through the production tubing string. This helps remove them from the immediate region of the perforation so that the agitated fines are removed and those fines need not pose any further problem.

The agitation achieved by the present apparatus is curative in that it does not have any detrimental impact on the well whatsoever. Further, repeated treatment of the well is permitted. It is particularly noteworthy that during the actual process of irradiation that the viscosity of the flowing fluids is reduced while the sedimentary fines are carried with the fluid flow. An example of the reduction of fluid viscosity by the acoustic treatment process of the present invention is shown by the Table I below.

TABLE I

| | Oil viscosity, relative units | | | | |
|---|---|---|---|---|---|
| Oil Samples | Before AT | 15 min AT | 30 min AT | 15 min after AT | 30 min after AT |
| Oil I | 10.65 | 9.71 | 9.13 | 9.94 | 10.64 |
| II, Sample 1 | 40.6 | 35.8 | 28.1 | 30.9 | 34.0 |
| II, Sample 2 | 40.2 | 33.7 | 27.9 | 29.9 | 31.8 |
| II, Sample 3 | 39.8 | 33.9 | 28.8 | 29.9 | 32.7 |
| II, Sample 4 | 43.1 | 33.1 | 29.0 | 31.4 | 33.6 |
| II, Sample 5 | 39.5 | 34.1 | 28.9 | 31.6 | 33.8 |
| II, Sample 6 | 40.0 | 33.6 | 28.7 | 31.1 | 33.0 |
| III, Sample 1 | 2490 | 1685 | 1268 | 1500 | 2177 |

(AT = acoustic treatment)

From the data shown in Table I, it can be seen that, with an acoustic treatment apparatus, such as shown in FIG. 2, suspended in a tank of oil (which is typical crude oil as produced from candidate wells for this treatment) that, in all cases while the acoustic treatment device is run, the oil viscosity (measured at different times) decreases. When the acoustic treatment device is turne off, the fluid viscosity increases somewhat, but only in the case of Oil I, Sample 1, does it return nearly to the original value. In the other cases, viscosity remains less than its initial value even after the acoustic treatment is stopped. This clearly indicates the lasting benefits of this treatment in producing wells.

Figure 3:
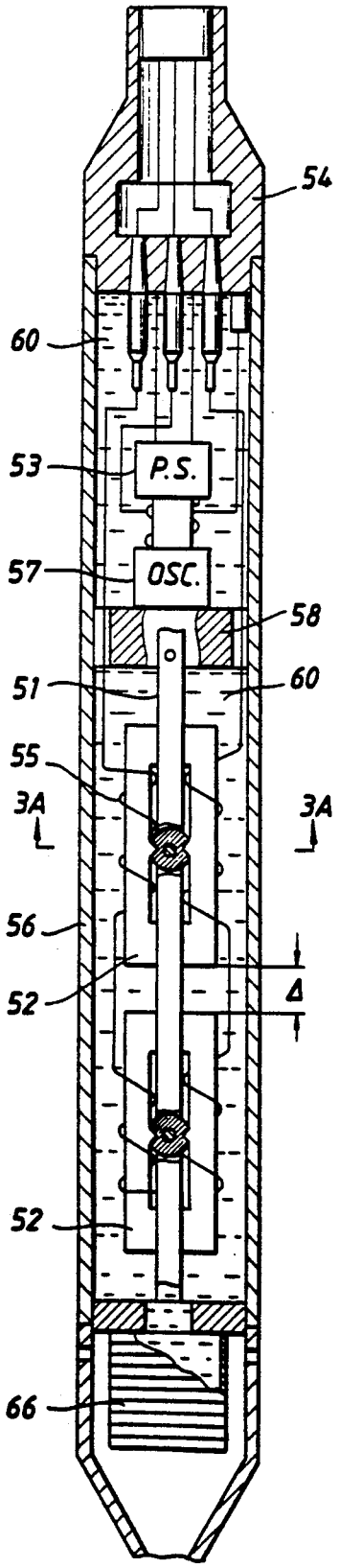
FIG. 3 shows a schematic of a second embodiment of an acoustic irradiation tool according to the concepts of the present invention.

A second embodiment of an acoustic radiation tool according to concepts of the present invention is illustrated schematically. In the tool of FIG. 3, an embodiment is shown having two spaced acoustic transducers elements 52 which are spaced apart a specified distance by using magnetostrictve transformers in the shape of rods 52, a range of frequencies from 5–30 kilohertz can be achieved by the transducer which still has a diameter small enough to pass through production tubing in the well.

Figure 5:
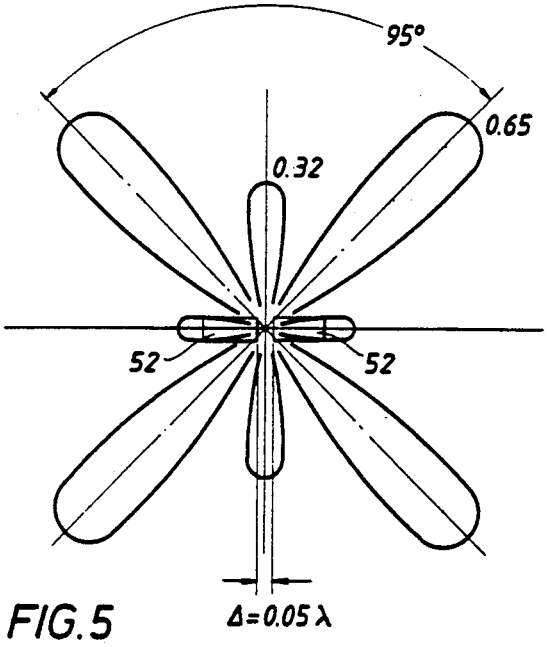
FIG. 5, 6, and 7 are diagrams illustrating the power distribution from an acoustic irradiation tool like that of FIG. 3 for different spacings of the acoustic transducer elements.
Figure 6:
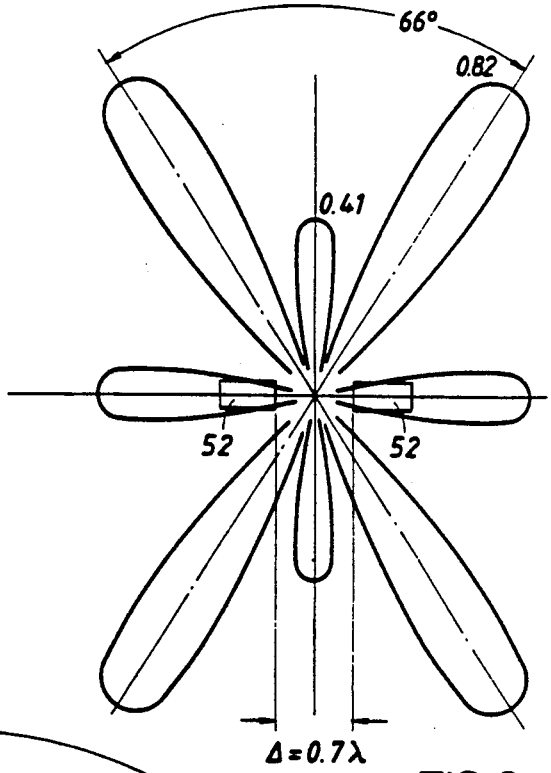
Figure 7:
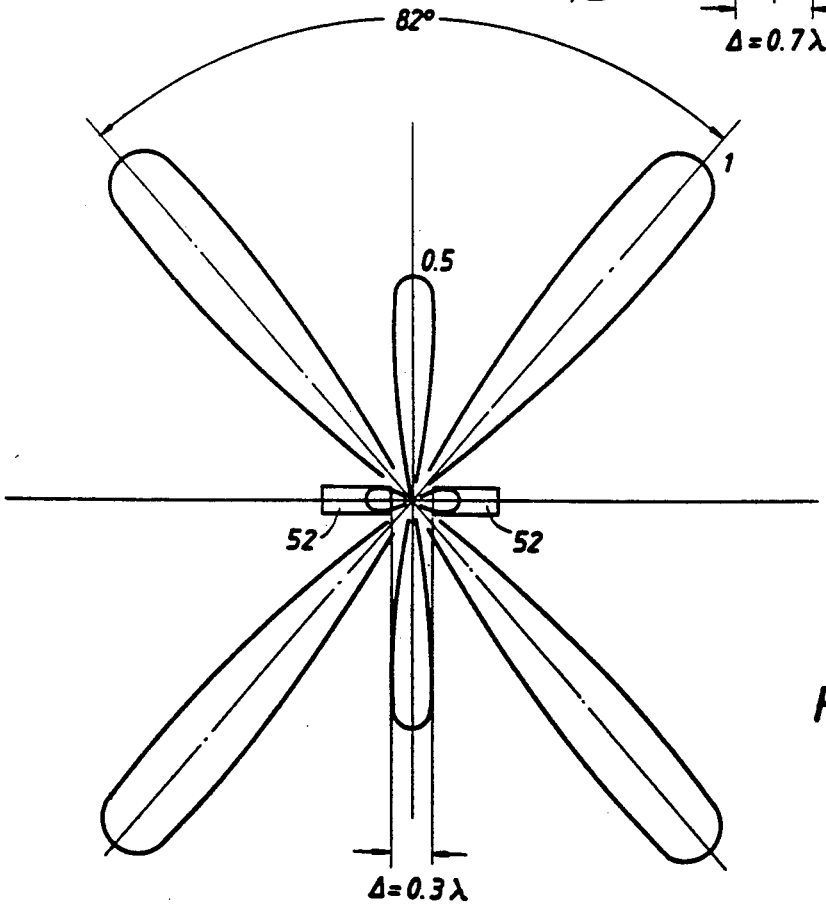

The magnetostrictive rod transducers also have higher reliability than toroidial shaped transducers since they are less susceptible to mechanical stress during the manufacturing process. By the proper choice of an operating frequency and spacing distance between the two acoustic transducers 52, the energy of the acoustic waves may be concentrated in a plane passing through the longitudinal axis of the two acoustic transducers. The angular distribution in this plane of the acoustic energy s influenced by the selection of the distance spacing, the distance apart of the two acoustic transducers. It has been found that when the distance Δ is between 0.2 and 0.5 times Λ (where Λ is the wavelength of the frequency of the acoustic radiator) that optimal angles of radiation occur having maximum side lobes from the tool longitudinal axis. FIGS. 5, 6, and 7 respectively illustrate the acoustic radiation lobes for spacings of 0.05 times Λ, 0.3 times Λ, and 0.7 times Λ. It will be noted that, for example in FIG. 6, other lobes than the main energy lobes are nearly absent when Δ spacings is appropriately chosen.

In view of the range of densities of well fluids normally encountered and for pressures and temperatures normally encountered in wells in which this instrument can be successfully utilized, the Δ spacing of approximately 0.2 to 0.5Λ has been shown as optimum for operating the device somewhere between about 5 and 30 kilohertz.

Figure 3A:
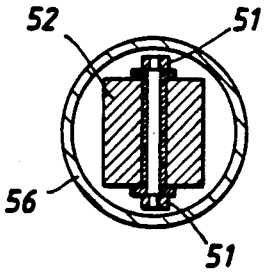
FIG. 3A in a cross section of the tool of FIG. 3 along the line A—A Of FIG. 3.

Returning now to FIG. 3, a well logging cable is shown schematically entering a cable head 54 to connect to a power supply to provide acoustic power to the spaced acoustic transducers 52 which comprise the magnetostrictive rods as previously discussed. The interior of the entire instrument is filled with a dielectric fluid 60, such as oil or the like. An expansion bellows 66 is located at the lower end of the tool in order to compensate for fluid expansion variations. A cross section along the line A—A through one of the acoustic transducers is shown in FIG. 3A. The two acoustic rods 52 are held in place in the interior of the sonde by two brackets 51 illustraed more particularly in FIG. 3A showing how the brackets on the two rod transducer elements to form a transducer assembly. Appropriate magnetic fields, of course, are introduced into the magnetostrictive rods by the windings 55 about each of the elements. Power from the cable is supplied via a power supply 53 therein. The outer tool housing 56 maybe constructed of an acoustically transparent material of sufficient thickness to with stand expected pressure differentials between the interior and the exterior of the tool. However, due to the pressure compensating bellows 66 and the dielectric oil 60 on the interior, the tool interior pressure remains near prevailing pressure in the well borehold at all times during its operation.

Figure 4:
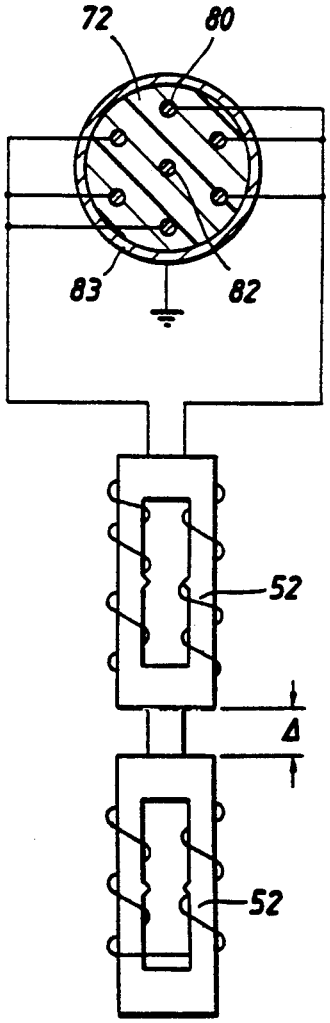
FIG. 4 is a schematic illustration of the connection of seven conductor cable connectors to an acoustic transducer.

FIG. 4 shows schematically a wiring diagram which illustrates electrical conductors from a typical armored logging cable 72 employed in transferring power from the logging cable to the spaced acoustic transducers 52 spaced at a distance Δ in the downhole tool. A seven conductor cable having an outer armor 83 and having a center conductor 82 is illustrated. Balanced conductor pairs of cable conductors may be connected in parallel to conduct larger currents from the cable to the directly to the transducers 52 in the manner illustrated in FIG. 4. Of course, it will be realized by those skilled in the art that the illustration of FIG. 4 merely shows one possible alternative for connecting logging cable conductors as three parallel pairs to the acoustic transducers assuming that a remote acoustic power oscillator were used to form the high power 5–30 khz electrical signal along the cable directly to the transducers 52 as illustrated in the device of FIG. 4. An equally attractive alternative might be to employ the cable conductors in a more conventional manner to deliver power to a downhole power supply located in the upper portion of the instrument (see FIG. 2) in order to drive a sonde supported oscillator in the manner previously described with respect to the instrument shown in FIG. 2.

In operation, the device of FIG. 3 is utilized in a manner similar to that previously discussed with respect to the device of FIG. 2. The instrument having the spaced acoustic transducers is lowered through the well head lubricator into the production tubing and through the top packer of the producing zone down into the producing zone. During this process, the pressure is equalized inside the tool by the operation of the expansion bellows 66. The instrument is lowered to a position where the two acoustic transducers are located to bracket the depth at which treatment is desired. The acoustic transducers are then activated producing the pattern in the normal plane between the two transducers similar to that shown in FIG. 6. This concentrates the acoustic energy generated by the transducer devices optimally to produce maximum agitation in that plane of activity. This process is continued for several minutes, between 5 and 30 minutes typically, and then the device moved vertically to a different location to treated the formation at different perforations in the producing zone. The process is then repeated at each desired depth in the producing zone until the all the perforations of the well are treated in this manner. Treatment of wells in the manner described in the present invention has been observed to increase the production of fluids from the well and to dislodge and clean fines from the perforations and the formation structure surrounding perforations. This is evidenced by the presence of fines in the produced fluids.

The foregoing descriptions may make other alternative embodiment according to the concepts of the present invention apparent to those of skill in the art. It is the aim of the impended claim to cover all such changes and modifications as fall within the true spirit and scope of the invention.

What is claimed:

1. A method for well treatment for stimulating fluid production in a producing well without stopping production from the well, comprising the steps of:

(a) running into a producing well on an electric wireline a well stimulating tool sized and adapted for passage through production tubing and placing said stimulating tool at a depth opposite perforations in a producing zone in the well;

(b) irradiating the area of the perforations with pulses of acoustic energy said acoustic energy having a frequency in the range from 5 kilohertz to 30 kilohertz and said pulses being repeated for a predetermined length of time;

(c) moving the stimulating tool to a different depth of perforations by raising or lowering said tool on said wireline and repeating step (b) at said different depths; and (d) wherein said acoustic irradiating steps move fines and decrease the well fluid viscosity in the vicinity of the perforations by agitation, thereby increasing fluid production from the well.

2. The method of claim 1 wherein the irradiating step is performed with an intensity of the acoustic radiation from 0.2 watts to 5 watts/cm$^2$ of area of the well being treated.

3. The method of claim 2 wherein the irradiating intensity is achieved through the use of acoustic radiation transducers which focus acoustic energy into a formations around the axis od said stimulating tool.

4. The method of claim 3 wherein said acoustic radiation transducers comprise dual acoustic transducers axially aligned in said stimulating tool spaced apart a distance $\Delta$ of from $0.2\Lambda$ to $0.5\Lambda$ where $\Lambda$ is the wavelength in the well of the acoustic energy being used for the irradiation process.

5. The method of claim 1 wherein the irradiating step is performed at each depth level for a selected time of between 5 minutes and 60 minutes.

6. The method of claim 1 wherein the step of irradiating involves the step of directing radiated acoustic energy away from the axis of the well simulating tool.

7. The method of claim 6 including the step of moving the tool to a well location opposite upper and lower perforations from the well.

8. The method of claim 1 including the step of irradiating the formation with acoustic radiation as a frequency above about 5 kilohertz.

9. The method of claim 8 wherein the frequency is up to about 30 kilohertz; and the acoustic radiation intensity is at least about 0.2 watts/cm$^2$.

10. The method of claim 9 wherein the acoustic radiation is provided in the form of continuous wave pulses.

11. An apparatus for stimulating fluid production in a well, comprising:

(a) an elongate sealed tool housing for running in a cased and perforated well borehole, said housing a liquid therein to couple and enable acoustic transmission through said housing into well fluids surrounding said housing;

(b) acoustic transducer means in said housing for forming a continuous wave acoustic energy pulse said acoustic energy having a frequency in the range from 5 kHz to 30 kHz for impinging on a formation to loosen fines for removal with formation fluid flow; and (c) said transducer means further acting on formation fluid flow by agitation thereof to reduce the viscosity thereof to enable enhanced flow from the formation into the perforations in the well.

12. The apparatus of claim 11 further including a connected power supply and oscillator to form repetitive electrical pulses applied to a coil means around a magnetostrictive means to form continuous wave acoustic pulses.

13. The apparatus of claim 12 including means for forming radially outwardly directed continuous wave acoustic pulse radiation energy for pulsed application to the well borehole and fluid therein.

14. The apparatus of claim 11 including upper and lower magnetostrictive means forming radially directed continuous wave acoustic energy radiation pulses impinging on the formation to loosen fines and also reduce viscosity of formation fluids by agitation to enhance formation production.

* * * * *